United States Patent [19]

Crall et al.

[11] 4,102,311

[45] Jul. 25, 1978

[54] CIRCUIT FOR GENERATING A SAWTOOTH ENGINE CRANK ANGLE SIGNAL AND AN ANALOG ENGINE SPEED SIGNAL

[75] Inventors: Frederick William Crall, Farmington; Lawrence William Tomczak; LaVerne Andrew Caron, both of Sterling Heights, all of Mich.

[73] Assignee: Chrysler Corporation, Highland Park, Mich.

[21] Appl. No.: 545,274

[22] Filed: Jan. 30, 1975

[51] Int. Cl.[2] ..... F02P 5/04

[52] U.S. Cl. ..... 123/117 R; 123/148 E

[58] Field of Search ..... 123/117 R, 148 E

[56] References Cited

U.S. PATENT DOCUMENTS

| | | | |
|---|---|---|---|
| 3,202,146 | 8/1965 | Short | 123/148 E |
| 3,592,178 | 7/1971 | Schiff | 123/117 R |
| 3,749,070 | 7/1973 | Oishi et al. | 123/117 R |
| 3,811,420 | 5/1974 | Vogel | 123/117 R |
| 3,867,916 | 2/1975 | Bigalke | 123/117 R |
| 3,874,351 | 4/1975 | Asler et al. | 123/117 R |
| 3,885,534 | 5/1975 | Webster | 123/117 R |
| 3,885,720 | 5/1975 | Brennan | 123/117 R |
| 3,910,243 | 10/1975 | Gau et al. | 123/148 E |

OTHER PUBLICATIONS

Del Toro and Parker; Principles of Control Systems Engineering, 1960, pp. 545–548, 572.

*Primary Examiner*—Charles J. Myhre
*Assistant Examiner*—R. A. Nelli
*Attorney, Agent, or Firm*—Baldwin & Newtson

[57] ABSTRACT

An integrator circuit is reset at predetermined engine crank angles to develop a sawtooth waveform representing engine crank angle. A comparator circuit, including an adjustable, voltage source output, is connected in a closed feedback loop around the integrator to regulate the peak of the sawtooth to a predetermined magnitude which is independent of engine speed, and, hence, independent of the sawtooth frequency. The analog output of the comparator represents engine speed. An adjustable calibration resistor in the integrator adjusts the integrator output to secure a desired relationship between the output of the comparator circuit and the frequency of the sawtooth. The complete circuit requires only two operational amplifiers and a small number of passive circuit elements.

3 Claims, 1 Drawing Figure

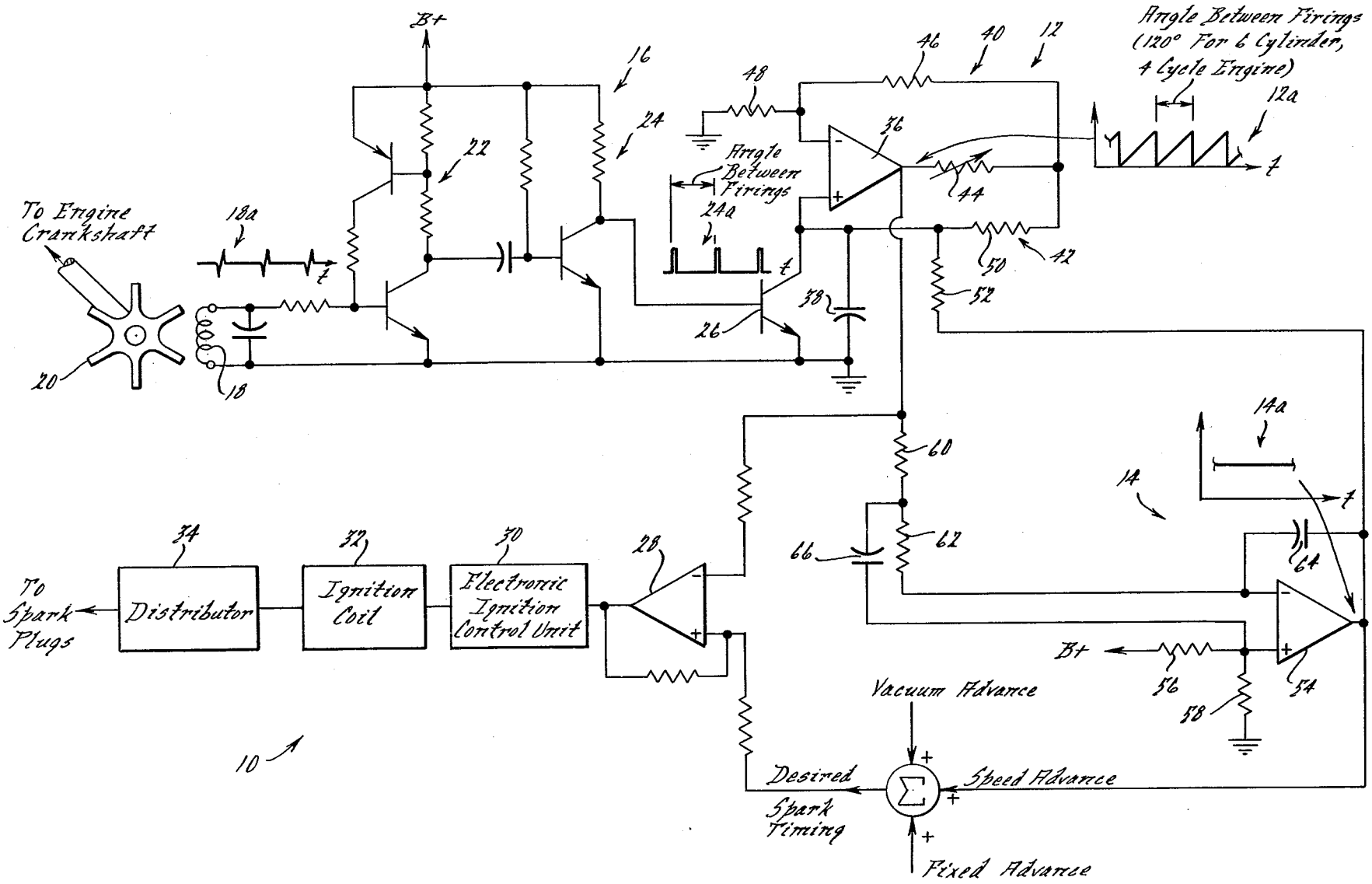
Angle Between Firings (120° For 6 Cylinder, 4 Cycle Engine)
Angle Between Firings
Vacuum Advance
Speed Advance
Fixed Advance
Desired Spark Timing
Electronic Ignition Control Unit
Ignition Coil
Distributor
To Spark Plugs
To Engine Crankshaft
B+

CIRCUIT FOR GENERATING A SAWTOOTH ENGINE CRANK ANGLE SIGNAL AND AN ANALOG ENGINE SPEED SIGNAL

BACKGROUND AND SUMMARY OF THE INVENTION

The present invention pertains broadly to electronic control circuits for internal combustion engines and, more particularly, to a novel circuit for generating a sawtooth engine crank angle signal and an analog engine speed signal.

In controlling the operation of an internal combustion engine (for example, controlling the engine spark timing) it is often necessary to generate a sawtooth signal representative of engine crank angle as well as an analog signal representative of engine speed. An example of a circuit for generating these two signals is disclosed and claimed in U.S. patent application Ser. No. 388,673 filed Aug. 15, 1973 now U.S. Pat. No. 3,885,534, and assigned to the same assignee as the present application. In that application, there is disclosed an integrator circuit which is periodically reset at predetermined engine crank angles to thereby develop a sawtooth waveform representative of engine crank angle and at a frequency representative of the speed of the engine. There is further disclosed in that application a comparator circuit and an adjustable current source which are connected with the integrator circuit in a closed feedback loop to cause the peak value of the integrator sawtooth waveform to be regulated to a desired magnitude over a range of engine speeds. The operation of this circuit may be briefly summarized by saying that the comparator circuit compares the peak value of the integrator sawtooth just prior to resetting thereof against a reference signal and in accordance with the result of the comparison causes the adjustable current source to supply current calculated to cause the peak of the sawtooth to be regulated to a fixed magnitude over a range of engine operating speeds. In this way, the magnitude of the sawtooth at any given instant of time accurately reflects the correct engine crank angle. Current from the adjustable current source is passed through a resistor to develop an analog voltage signal representative of the speed of the engine.

One feature of the present invention is that both a sawtooth engine crank angle signal and an analog engine speed signal can be developed by using only two operational amplifiers in conjunction with a small number of passive circuit components. This is important in simplifying construction of this type of circuit for production application. Another feature of the present invention is the provision of an adjustable calibrating resistor in the integrator circuit which enables the magnitude of the analog engine speed signal to be more accurately related to the actual engine speed as established by the frequency of the sawtooth signal. Additional features, advantages, and benefits of the invention along with those already enumerated, will be seen in the ensuing description and claims which are to be taken in conjunction with accompanying drawing.

BRIEF DESCRIPTION OF THE DRAWING

The drawing illustrates a preferred embodiment of the present invention according to the best mode presently contemplated for carrying out the invention.

The single drawing FIGURE is a schematic diagram of an engine spark timing control circuit including a circuit for generating a sawtooth engine crank angle signal and an analog engine speed signal pursuant to principles of the present invention.

DESCRIPTION OF THE PREFERRED EMBODIMENT

As shown in the drawing, circuitry embodying principles of the present invention is shown in an electronic engine spark timing control system 10 which controls the timing of the ignition spark delivered to the cylinders of the engine in accordance with certain engine operating conditions, such as the intake manifold vacuum and the engine speed. The circuitry of the present invention may be considered as a two-stage circuit comprising an integrator circuit 12 and a comparator circuit 14. Integrator circuit 12 develops a sawtooth waveform representative of engine crank angle (illustrated at **12*a*) while comparator circuit 14 develops an analog engine speed signal (illustrated at 14*a*). Furthermore, comparator circuit 14 is connected in a closed feedback loop with integrator circuit 12** to regulate the peak magnitude of the sawtooth to a desired magnitude which is independent of engine speed.

Integrator circuit 12 is operatively coupled with the engine crank shaft via a noise immune reset circuit 16 which is disclosed in detail in U.S. patent application Ser. No. 545,275 entitled "Noise Immune Reset Circuit for Resetting the Integrator of an Electronic Engine Spark Timing Controller" filed of even date herewith and assigned to the same assignee as the present invention, and whose disclosure is incorporated herein by reference. Reset circuit 16 comprises a pickup coil 18 in which a pulse train (illustrated at **18*a*) is developed by means of a toothed reluctor wheel 20 which is operatively coupled to the engine crank shaft for rotation at a speed which is representative of the engine crank shaft rotational speed. The waveform 18*a* consists of a pulse train of spaced bi-polar pulses which are spaced apart a predetermined number of engine crank angle degrees, for example, 720° ÷ N in a four cycle engine where N is the number of cylinders and 360°/N in a two stroke engine where N is the number of cylinders. In the ensuing description it will be assumed that the invention is used in a six cylinder engine so that the pulses will be 120° apart. The bi-polar pulses of waveform 18*a* are applied to a bi-stable circuit 22. The output of bi-stable circuit 22 is coupled to a monostable circuit 24 which supplies a waveform consisting of reset pulses (illustrated at 24*a*) to the base of an NPN transistor 26. Briefly, the noise immune reset circuit develops the waveform 24*a* to provide short reset current pulses which switch transistor 26 into conduction for the duration of each reset pulse. The pulses are spaced apart 120° of engine crank angle and are of short angular duration relative to the angular spacing between the individual pulses. Therefore, transistor 26 is switched into conduction for a very short time period every time a pulse is supplied to reset integrator circuit 12. Since the frequency of the pulses is indicative of the engine crank shaft speed, integrator circuit 12** is reset at a frequency which is representative of the engine speed.

Before considering further details of the integrator circuit 12 and comparator circuit 14, it should be explained that the sawtooth waveform **12*a* is used in conjunction with a controlled spark timing signal to determine the time at which an ignition spark is delivered. This is done through a comparator circuit 28, an electronic ignition control unit 30, an ignition coil 32 and a distributor 34. Briefly, comparator 28 compares the sawtooth waveform 12***a* with an analog signal representing desired engine spark timing which signal is developed in accordance with various engine operating parameters (including the analog engine speed signal developed by comparator circuit 14). When comparator 28 senses passage of the sawtooth waveform through the level of the analog spark timing signal, it provides an output signal to electronic ignition control unit 30 which in turn fires ignition coil 32 to develop an ignition spark which is delivered via distributor 34 to the appropriate spark plug of the engine. Because the level of the analog signal is controllably varied in accordance with engine operating conditions, the crank angle at which the sawtooth passes through the level of the analog signal will vary to thereby vary the crank angle at which an ignition spark is delivered. The spark timing is thus accurately controlled to obtain improved engine performance. Since the details of electronic ignition control unit 30, ignition coil 32 and distributor 34 are entirely conventional and form no part of the present invention, reference may be had to other patents (such as U.S. Pat. No. 3,749,974 assigned to the same assignee as the present invention) for details thereof.

With the foregoing overall description in mind, particular attention may now be directed toward the details of integrator circuit 12 and comparator circuit 14. Integrator circuit 12 comprises an operational amplifier 36 (illustratively a voltage type operational amplifier), a capacitor 38 and a pair of coupling circuits 40 and 42 which couple the output of amplifier 36 respectively to the inverting and non-inverting inputs thereof. (It will be appreciated that the amplifier is suitably connected with the power supply although the actual connection is not shown in the schematic.) According to one feature of the present invention, an adjustable calibration element, in the form of an adjustable resistor 44, is operatively connected in common with both coupling circuits 40 and 42. As will become apparent from further description, the adjustable resistor 44 permits the analog engine speed signal developed by comparator circuit 14 to be more accurately and precisely calibrated to the actual engine speed as represented by the frequency of the sawtooth waveform 12*a*. Coupling circuit 40 further includes a pair of resistors 46 and 48; and coupling circuit 42, a pair of resistors 50 and 52. Resistors 44, 46, and 48 form a voltage divider from the output of amplifier 36 to ground with the junction of resistors 46 and 48 being connected directly to the inverting input terminal of amplifier 36. Similarly, resistors 44, 50 and 52 form a voltage divider between the output of amplifier 36 and the output of an operational amplifier 54 in comparator circuit 14, which is identical to operational amplifier 36. The junction of resistors 50 and 52 is directly connected to the non-inverting input of amplifier 36. Capacitor 38 is connected between the non-inverting input of amplifier 36 and ground with the emitter-collector circuit of transistor 26 shunting capacitor 38.

By selecting the specific values of resistors 44, 46, 48, 50 and 52 and capacitor 38 in accordance with known design techniques, the output signal appearing at the output of amplifier 36 will be a given linear function of time, assuming that transistor 26 is non-conducting. To achieve linearity the resistances of resistors 46 and 50 should be equal and the resistances of resistors 48 and 52 should be equal. If transistor 26 is conducting, the output of amplifier 36 is forced to ground. Hence, by subjecting transistor 26 to conduction in accordance with waveform 24*a*, capacitor 38 is periodically charged and discharged to create a sawtooth waveform at the output of amplifier 36. Since adjustable resistor 44 is common to both coupling circuits 40 and 42, it may be adjusted to similarly adjust the given linear function of the integrator but without impairing the linearity of the integrator. As will become apparent hereinafter, the adjustment of resistor 44 permits the gain of the integrator to be accurately adjusted to a gain which will cause the analog engine speed signal to be in a predetermined ratio to the frequency of the sawtooth waveform 12*a* and, hence, very accurately and precisely reflect the true engine speed.

Comparator circuit 14 comprises, in addition to operational amplifier 54, a reference circuit which provides a reference signal to the non-inverting input of operational amplifier 54 and a coupling circuit via which the sawtooth waveform 12*a* from integrator circuit 12 is coupled to operational amplifier 54. The reference circuit is defined by a pair of resistors 56, 58 connected in series across the power supply for the circuit with the junction of the two resistors being connected to the non-inverting input terminal of amplifier 54 to supply the reference signal thereto. The coupling circuit via which the sawtooth waveform is supplied to amplifier 54 includes a pair of resistors 60 and 62 which connect directly in series from the output of amplifier 36 to the inverting input of amplifier 54 and a capacitor 64 which connects between the output and the inverting input of amplifier 54. A high frequency noise suppression capacitor 66 is preferably connected from the junction of resistors 60 and 62 to the non-inverting input of amplifier 54. The values of resistors 60 and 62 and capacitor 64 are selected using known design techniques to provide a frequency response for the circuit which causes the circuit output to track changes in the frequency of the sawtooth waveform 12*a*. In doing so, the circuit develops at the output of amplifier 54 a voltage which varies in magnitude with changes in the frequency of the sawtooth waveform. Furthermore, the coupling circuit scales the sawtooth waveform relative to the reference signal such that the output of amplifier 54 becomes increasingly positive as the engine speed increases from idle. The circuit parameters also should be selected to provide at engine idle speed, a minimum amount of ripple in the output of the operational amplifier since the ripple will tend to decrease as the speed of the engine increases. Hence, the output voltage of the comparator circuit, as taken at the output of amplifier 54, is representative of the engine speed and more particularly is essentially directly proportional to engine speed.

By virtue of the feedback connection of resistor 52 to capacitor 38, the comparator creates an adjustable current flow into the capacitor which will be in addition to the capacitor charging current which is supplied from integrator circuit 12 alone. The value of resistor 52 is chosen such that for a given sawtooth frequency, just enough additional charging current is supplied from comparator circuit 14 to cause the peak of the sawtooth to equal the desired magnitude at which it is regulated. As the frequency of the sawtooth changes, the feedback current also changes so that the peak is always regulated to the desired magnitude over the range of engine speed.

The importance of adjustable resistor 44 may now be explained. As one knowledgeable in the electronic art will readily appreciate, individual electronic circuit components are subject to certain tolerances. By way of example, the capacitor 38 may exhibit a tolerance of for example, plus or minus 5% or even plus or minus 10%. Therefore, in mass assembly of an integrator circuit of this design, the tolerance of the capacitor, and other circuit elements for that matter, will create a tolerance in the given linear function which the integrator circuit will output by itself. By closed-loop regulation of the integrator, as illustratively described above, the peak magnitude of the sawtooth is always forced to the desired value because of such closed-loop regulation. In other words, the inclusion of a feedback circuit will always tend to null out any error between the actual peak and the desired peak of the sawtooth. The present invention, in one of its aspects, has recognized that closed-loop regulation of the sawtooth does not inherently guarantee an exact ratio of the analog output signal of the comparator to the frequency of the sawtooth, although the analog output signal will approximate such an exact ratio. By providing adjustable resistor 44, the slope of the integrator output may be expeditiously adjusted to a precise value to guarantee the desired exact ratio between the analog output signal and the frequency of the sawtooth. Because an exact ratio between the analog output signal and the frequency of the sawtooth can always be attained through appropriate setting of resistor 44, the spark timing is more precisely controlled thereby improving engine operating performance. Furthermore, the invention requires only two operational amplifiers and a small number of passive circuit components and this construction is advantageous with respect to both cost and reliability.

What is claimed is:

1. In an electronic engine spark timing controller for controlling the timing of spark ignition in an internal combustion engine, the combination comprising:

a closed-loop regulated sawtooth generator comprising an integrator circuit which provides an output signal having a magnitude which changes as a given linear function of time and is periodically reset to an initial value at predetermined engine crank angles to thereby develop a sawtooth waveform whose frequency is representative of the speed of the engine;

a comparator circuit having input circuit means and output circuit means;

a reference circuit for providing a reference signal whose magnitude is representative of a magnitude of said sawtooth waveform which is desired immediately prior to the resetting of said integrator circuit;

means operatively coupling said reference and integrator circuits to the input circuit means of said comparator circuit so that said reference signal and said sawtooth waveform may be compared by said comparator circuit, said comparator circuit including means for providing at its output circuit means an adjustment signal whose magnitude is a function of the comparison between said reference signal and the actual magnitude of said sawtooth waveform immediately prior to the resetting of said integrator circuit, and means operatively coupled with the output circuit means of said comparator circuit for feeding back said said adjustment signal to said integrator circuit to cause the actual magnitude of said sawtooth waveform immediately prior to resetting of said integrator circuit to be closed-loop regulated to said desired magnitude thereof over a range of engine operating speeds;

an adjustable calibration element operatively coupled in said integrator circuit for adjusting the gain thereof to cause the magnitude of said adjustment signal to bear a desired relationship to the frequency of said sawtooth waveform without affecting the linearity of the output signal of said integrator circuit or said desired magnitude to which said sawtooth waveform is closed-loop regulated;

and means for controlling the engine spark timing including means for controlling the engine spark timing in accordance with the magnitude of said adjustment signal;

wherein said integrator circuit comprises an operational amplifier having a pair of inputs and an output, a coupling circuit connecting said operational amplifier output with one of said operational amplifier inputs, a second coupling circuit connecting said operational amplifier output with the other of said operational amplifier inputs, said adjustable calibration element being connected in common with both said coupling circuits, and a capacitor operatively connected in one of said coupling circuits and arranged so that the charging rate thereof controls the rate of change of the output signal of said integrator circuit, and wherein said comparator circuit includes an operational amplifier and a resistor connected in the output thereof to provide an adjustable current source which produces said adjustment signal.

2. In an electronic engine spark timing controller for controlling the timing of spark ignition in an internal combustion engine, the combination comprising:

a closed-loop regulated sawtooth generator comprising an integrator circuit which provides an output signal having a magnitude which changes as a given linear function of time and is periodically reset to an initial value at predetermined engine crank angles to thereby develop a sawtooth waveform whose frequency is representative of the speed of the engine;

a comparator circuit having input circuit means and output circuit means;

a reference circuit for providing a reference signal whose magnitude is representative of a magnitude of said sawtooth waveform which is desired immediately prior to the resetting of said integrator circuit;

means operatively coupling said reference and integrator circuits to the input circuit means of said comparator circuit so that said reference signal and said sawtooth waveform may be compared by said comparator circuit, said comparator circuit including means for providing at its output circuit means an adjustment signal whose magnitude is a function of the comparison between said reference signal and the actual magnitude of said sawtooth waveform immediately prior to the resetting of said integrator circuit, and means operatively coupled with the output circuit means of said comparator circuit for feeding back said adjustment signal to said integrator circuit to cause the actual magnitude of said sawtooth waveform immediately prior to resetting of said integrator circuit to be closed-loop regulated to said desired magnitude thereof over a range of engine operating speeds;

adjustable calibration means for calibrating said adjustment signal so that the magnitude thereof bears a desired relationship to the frequency of said sawtooth waveform, and hence to the speed of the engine, said adjustable calibration means comprising an adjustable calibration element operatively coupled in said integrator circuit which may be adjusted to adjust the gain of the integrator circuit witout affecting the linearity of the output signal of said integrator cirucit or said desired magnitude to which said sawtooth waveform is closed-loop regulated;

and means for controlling the engine spark timing including means for controlling the engine spark timing in accordance with the magnitude of said adjustment signal;

wherein said integrator circuit comprises an operational amplifier having a pair of inputs and an output, said sawtooth waveform being developed at said operational amplifier output, and a pair of coupling circuits each of which couples said operational amplifier output with a corresponding one of the operational amplifier inputs, and said adjustable calibration element is connected in common with both said coupling circuits.

3. The combination recited in claim 2 wherein said adjustable calibration element comprises an adjustable resistor.

* * * * *